United States Patent [19]

Spademan

[11] Patent Number: 4,924,605

[45] Date of Patent: May 15, 1990

[54] SHOE DYNAMIC FITTING AND SHOCK ABSORBTION SYSTEM

[76] Inventor: Richard G. Spademan, Box 6410, Incline Village, Nev. 89450

[21] Appl. No.: 11,409

[22] Filed: Feb. 4, 1987

Related U.S. Application Data

[63] Continuation of Ser. No. 736,666, May 22, 1985, abandoned.

[51] Int. Cl.[5] ..... A43B 5/00; A43B 7/14

[52] U.S. Cl. ..... 36/114; 36/119; 36/88

[58] Field of Search ..... 36/88, 114, 119, 121, 36/71.5, 70 R, 132, 50, 109, 58.5, 89

[56] References Cited

U.S. PATENT DOCUMENTS

| | | | |
|---|---|---|---|
| 1,286,787 | 12/1918 | Rakahr | 36/114 |
| 3,828,448 | 8/1974 | Leonildo | 36/119 |
| 4,030,215 | 6/1977 | Vogel | 36/119 |
| 4,196,530 | 4/1980 | Delery | 36/119 |
| 4,222,184 | 9/1980 | Kastinger | 36/121 |
| 4,236,328 | 12/1980 | Friedlander | 36/58.5 |
| 4,342,161 | 8/1982 | Schmohl | 36/58.5 |
| 4,366,631 | 1/1983 | Larsen et al. | 36/114 |
| 4,446,634 | 5/1984 | Johnson et al. | 36/28 |
| 4,447,968 | 5/1984 | Spademan | 36/119 |
| 4,546,555 | 10/1985 | Spademan | 36/29 |

FOREIGN PATENT DOCUMENTS

| | | | |
|---|---|---|---|
| 0040782 | 12/1981 | European Pat. Off. | 36/88 |

OTHER PUBLICATIONS

WO 81/01645, 6/1981, PCT Spademan.
WO 80/02789, 12/1980, PCT Spademan.

*Primary Examiner*—Steven N. Meyers
*Attorney, Agent, or Firm*—Townsend & Townsend

[57] ABSTRACT

A shoe having a dynamic fitting and shock absorption system. Disposed within the shoe is an insert defined by a sensing means including a U-shaped pivot bar that straddles a movable footbed. The bar has an upper end attached to a strap extending over the instep and forefoot. The opposite end of the strap is attached to the footbed. The bar is pivotally secured to the sides of the footbed. The lower end of the bar rests on the shoe sole. Movement of the footbed in a downward direction upon foot strike pivots the bar toward a position parallel to the footbed dynamically tightening the strap on the foot and distributing a portion of the shock load to the midfoot and forefoot.

23 Claims, 7 Drawing Sheets

SHOE DYNAMIC FITTING AND SHOCK ABSORBTION SYSTEM

This is a continuation of application Ser. No. 06/736,666, filed May 22, 1985, now abandoned.

BACKGROUND OF THE INVENTION

Sport shoes such as running, tennis, basketball or soccer, as well as skates, ski boots and the like must fit tightly on the user's foot. During certain maneuvers, with a running shoe during heel strike and toe off, for example, the tightness of the fit needs to be greater than during other times such as midstance when the forces transmitted between the foot and the ground via the shoe are not as severe. In court and contact sport shoes the tightness of the fit needs to be greatest when the largest forces are being applied between the shoe and the playing surface. In the past, it was typical to tighten the shoe as much as possible, and physically bearable, to prevent or at least minimize relative movement of the foot in the shoe at times when maximum forces were transmitted between the floor and the shoe. As a practical matter, such a fit is excessively tight during most other times and quite frequently is uncomfortable, can lead to numbness and, in extreme cases, can even result in injuries. Thus, a compromise is frequently reached by tightening the shoe on the foot more than is necessary for the small forces that are applied and less than is desired to prevent relative movement of the foot in the shoe when large forces are applied. Consequently, the fit of such shoes is almost always other than what it should be.

This problem has been recognized in the past in connection with ski boots where the exerted forces are especially large and the required tightness of the fit for extreme maneuvers is typically unbearable for any length of time. Thus, this inventor has developed dynamic fitting systems which temporarily increase the tightness of the fit of the boot on the foot in response to certain skiing maneuvers, for example, by constructing the ski boot so that the tightness of the fit of the boot, or of at least a portion of the boot increases in response to a forward lean of the skier. U.S. Pat. No. 4,360,979, entitled A SPORT SHOE WITH A DYNAMIC ADJUSTABLE CUFF ASSEMBLY, and U.S. Pat. No. 4,382,342, entitled DYNAMIC FITTING SYSTEM FOR A SPORT SHOE, describe such dynamic fitting systems.

In many respects, ski boots present a particular problem because it is one of their objectives to significantly limit the mobility of the user's ankle joint. For practical purposes, the skier's leg is movable in only a forward direction and even this movement is greatly limited when compared with the anatomical freedom of movement provided by the ankle joint. Further, ski boots are large, relatively bulky and have thick walls to provide the desired strength, rigidity and heat insulation. Consequently, there is ample space within which to build a system to tighten the boot in response to a particular movement, e.g. flex of the leg relative to the foot.

Up to now, little or no consideration has been given to the relative tightness of sport shoes, particularly lightweight, highly mobile sport shoes such as running, tennis, soccer shoes and the like. The lightness of such sport shoes and the lack of an adequate analysis of the interaction between the sport shoe and the user's foot led to the practice of simply tightening the shoe to suit the user's taste, feel or preference. In some instances, the shoe might be too loose and not infrequently, slipped significantly relative to the foot in a particularly strenuous maneuver such as a sudden change in direction when turning. This was considered an inevitable adjunct to participating in sports.

Upon closer analysis, however, it becomes apparent that there are distinct phases in the use of a sport shoe when forces applied by the foot to the shoe momentarily greatly exceed the normally encountered forces. In running, for example, when the runner places his weight on the forefoot just prior to lifting the foot off the ground, there are significant forces which tend to push the foot in a rearward direction relative to the shoe. Conversely, during heel strike, that is when the foot contacts the ground at the end of a stride, there are forces generated by both the runner's weight and the deceleration of the foot which tend to move the foot in a forward direction relative to the shoe. Such movements may be relatively small, say in the order of no more than a few millimeters but they are present and, typically, they are repeated thousands of times during a single run. This can lead to discomfort, skin irritation from rubbing between the floor and the shoe and energy losses which though small are highly undesirable, particularly in competitive sports. The problem is magnified in contact type team sports where the forces can be significantly greater than those encountered during running, for example. Up to now, no solution to this problem has been available.

SUMMARY OF THE INVENTION

The present invention greatly reduces or eliminates relative movement between the foot and the sport shoe while improving shock absorbtion characteristics by increasing the tightness of the fit of the shoe on the foot as a function of weighting the shoe during foot strike and throughout shoe-playing surface contact. At the same time, the tightness of the fit can be reduced when the foot is in its unweighted condition when minimum forces are exerted to prevent discomfort or possible injury from an overtightening of the shoe for excessive lengths of time. In particular, the present invention increases the tightness of the fit when the foot weights the sole or a dynamically movable footbed upon foot strike resulting in a tightening of the shoe in the hindfoot, midfoot and forefoot. The invention also provides means for dispersing the energy of foot strike impact by the movement of the sole or the footbed distributing the shock load impulse to the midfoot and forefoot.

Broadly speaking, therefore, the present invention provides a sport shoe forming a comfortable close fit on the foot of the lower extremity when the foot is in a generally unweighted condition. The tightness of the fit is increased when the foot is placed in a weighted condition. This is accomplished with means for sensing a relative weighting of the sole or a dynamically movable footbed and means operatively coupled with the sensing means and the shoe for increasing the tightness of the fit of the shoe on the foot in response to a relative weighting of the lower extremity when the foot moves downwardly toward the sole of the shoe. This system can be directly incorporated in a sport shoe and in such an instance forms an integral part thereof. Alternatively, the system can be provided in the form of a kit that is adapted to be placed into a conventional sport shoe to convert such a shoe into one having the above discussed characteristics.

One embodiment of the invention provides that the sensing means be defined by a bar which straddles a movable footbed and which has an upper end attached to one end of a strap or apron extending over the instep and forefoot. The opposite end of the strap is then attached to the footbed. The bar is pivotally attached to the lateral sides of the footbed. The lower end of the bar rests on the upper surface of the sole so that movement of the foot in a downward direction pivots the bar with respect to the shoe. The strap or apron is attached to the upper end of the bar so that pivotal movement of the bar in a direction to move the bar towards a position parallel to the footbed increases the tightness of the strap or apron on the foot as a function of the extent to which the foot has moved toward the sole of the shoe. A separate forefoot strap that tightens over the forefoot upon toe off can be connected to the pivoting bar.

In another embodiment of the invention, a strap is secured to the inside of the sport shoe medial heel counter wall and then passes through a slot on the medial side of a dynamically movable footbed. The strap is flared over the instep and forefoot and then passes through a slot on the lateral side of the footbed and is secured to the inside of the lateral heel counter wall. Weighting of the dynamically movable footbed moves the footbed downwardly tightening the strap over the instep and the heel counter against the heel.

In a running shoe, therefore, the tightness of the fit is increased during foot strike when the foot is weighted and the dynamically movable footbed moves toward the ground. Depending on the individual's running style, plantarflexion and dorsiflexion of the foot may take place during different phases of heel strike, midstance and toe off. Consequently, during those moments when large forces are transmitted from the foot to the ground via the shoe, the shoe fits the tightest, thereby reducing or eliminating movements of the foot in the shoe.

Preferably, the shoe instep strap is attached to an insert within the shoe which is defined by a footbed that extends forwardly from the heel to about the metatarsal-phalangeal area or the ball of the user's foot. The footbed helps to anchor the insert in the shoe and for this purpose can either be semirigid or rigid. By constructing it of semirigid or rigid materials, it further acts as a movable footbed to press the instep strap against the foot to increase the tightness of the fit. For purposes of this application the term "rigid footbed", which forms part of the insert, means and is intended to mean, a footbed which has a rigidity that is about equal to or slightly greater than the rigidity of the shoe sole. This should be contrasted with the term "flexible footbed" which can also be attached to the insert but which is substantially more flexible than the shoe sole.

Other aspects of the present invention permit the adjustment of the instep strap relative to the shoe, the bar and the insert so as to adapt it for use with feet of differing sizes.

To summarize, therefore, the present invention provides a dynamic fitting system for sport shoes which allows a reduced tightness unweighted condition for the foot when the tightness of the fit is at a minimum and which increases the tightness in response to movement of the foot toward the sole. This greatly enhances the utility of a sport shoe in that it is tightest on the foot when the foot is moved downwardly which typically is the condition in which maximum forces are transmitted between the foot and the shoe. Due to the tightness of the fit, relative movements between the foot and the shoe are minimized or eliminated. Yet, the discomfort and possibility of injury which would accompany the use of a shoe tightened to take into account maximum forces, which are encountered for only fractions of a second, are eliminated, because when the foot is in its relative unweighted position, or in a position which deviates therefrom by only a minor amount, the fit of the shoe can be such as to cause no discomfort whatsoever.

Aside from momentarily increasing the tightness with which the shoe fits on the wearer's foot, the fitting system of the present invention also absorbs shock and helps reduce the maximum forces to which the foot is subjected. This aspect of the present invention renders it particularly suitable for running shoes when during a single run the foot strikes the ground thousand of times, each time subjecting it to forces of a magnitude that may exceed the user's weight several times. This shock absorbing characteristic results from the relative lowering of the foot when the shoe touches the ground during heel strike and as the foot moves towards its midstance position. Thus, when the shoe sole first strikes the ground, the runner's heel is still spaced from the sole and it is permitted to decelerate over a significant distance as compared to the distance over which the foot can decelerate when in direct contact with the shoe sole. Also, the impact shock is dispersed to the midfoot and forefoot. This greatly reduces the maximum impulse force to which the foot, and indeed the entire leg of the user, including his knee, which is particularly susceptible to injury from excessive impact forces, is subjected. In the past, impact forces during heel strike could only be lowered by making the shoe sole of a resiliently compressible material, such as closed cell foam. The extent to which the forces can be reduced in this manner, is severely limited because an undue resiliency in the shoe sole renders it uncomfortable and unstable. Moreover, the resiliency of the material is quickly lost due to permanent set in the material.

DESCRIPTION OF THE PREFERRED EMBODIMENTS

Figure 1:
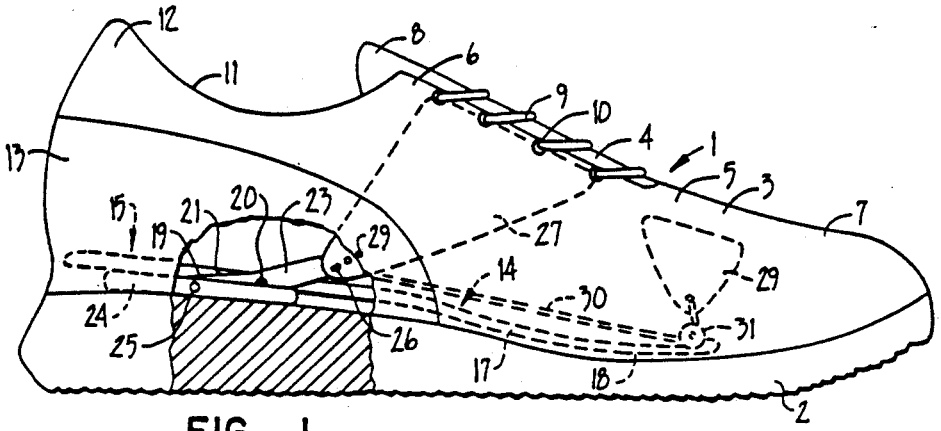
FIG. 1 is a side elevational view of a shoe provided with a dynamic fitting and shock absorbtion system in an unweighted position constructed in accordance with the present invention.
Figure 3:
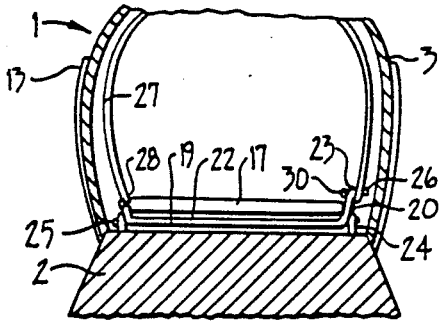
FIG. 3 is a side elevational view of the shoe of FIG. 1 with the dynamic fitting and shock absorbtion system in a weighted position.
Figure 2:
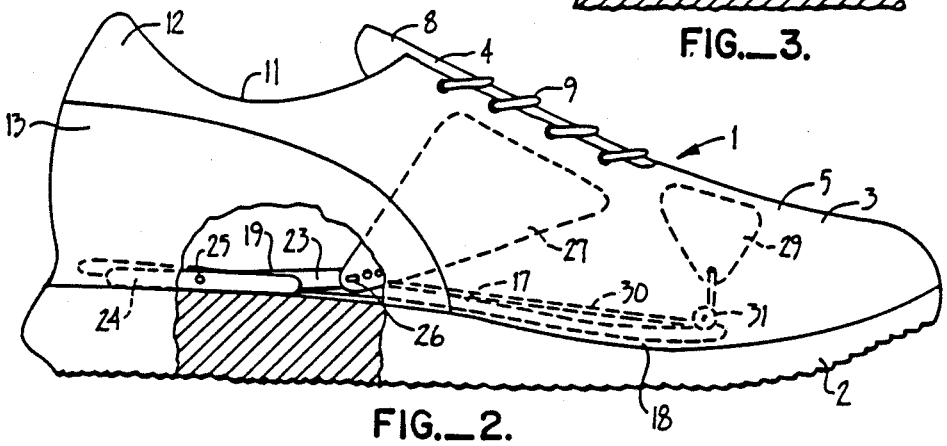
FIG. 2 is a vertical section through the shoe of FIG. 1.

Referring to FIGS. 1–3, a shoe 1 such as a running shoe has lower sole 2 constructed of a resilient material such as an elastomer and an upper shell 3 constructed of a flexible material such as leather or nylon secured to the lower sole and defining the inside of the shoe within which the user places his foot. The upper shell of the shoe includes a conventional, typically v-shaped cut out 4 above the forefoot 5 and extending generally from about the instep 6 towards a front or toe end 7 of the shoe. A tongue 8 underlies the cut out and is secured to the upper in the vicinity of the toe end. The v-shaped cut out may be closed by laces 9 passing through eyelets 10 arranged in the conventional manner. The upper is further defined by a cuff 11 which is usually located below the user's ankle joint. The upper terminates in a heel end 12 which surrounds and engages the users heel and which includes a heel counter 13.

Disposed within the shoe is an insert 14 which forms part of the shoe dynamic fitting and shock absorbtion system 15 of the present invention. The insert is defined by a footbed 17 which extends forwardly from the heel end, rests on the shoe sole and terminates in the area of the ball 18 of the user's foot. Thus, in use, the insert engages the underside of the foot from the heel to about the ball of the foot.

A sensor in the form of a U-shaped pivot bar 19 straddles the footbed. The pivot bar pivots about pivot pins 20 which are secured to the sides of the footbed. The pivot bar has lower segments 21 connected by a cross member 22 and an upper segment 23. Load distributing bars 24 are pivoted by pivot pins 25 from the base of the lower segments 21 and rest on the upper surface of the sole.

The upper end of the upper segment has an outwardly extending strap hook 26. One end of an instep strap 27 is connected by the strap hook to the pivot bar. The strap then extends over the instep and forefoot of the user and is attached on the opposite end to the side 28 of the footbed. Instep strap adjustment holes 29 engage the strap hook so as to adapt the instep strap for use with feet of differing sizes. A spring (not shown) may be interposed between the instep strap and the pivot bar strap hook to absorb a portion of the shock load of foot strike.

In use, a foot is initially placed inside the shoe in an unweighted condition and the instep strap 27 is adjusted to provide a close fit on the foot with the footbed resting a distance above the sole. When the user places weight on his foot as during foot strike the footbed 17 is lowered toward the sole 2 causing clockwise rotation of the pivot bar 19 toward a position parallel to the footbed. Thus, the instep strap is pulled downwardly, inwardly and rearwardly against the upper surface of the foot. As a result, the tightness with which the shoe fits on the foot is increased and relative movements of the foot in the shoe are reduced even though the forces that are exerted between them might be momentarily very high. In addition, the tightening of the instep strap on the upper surface of the foot distributes a portion of the shock load of foot strike to the midfoot and forefoot. When the downward force is removed from the footbed such as during the latter phase of toe off and swing though, the pivot bar rotates counterclockwise loosening the instep strap on the foot. A forefoot strap 29 may be attached by one end to the side of the footbed and the opposite end connected by a cable 30 to the upper segment 23 of the pivot bar 19. The cable passes around a pulley 31 attached to the footbed so that counterclockwise rotation of the pivot bar in unweighting of the foot tightens the forefoot strap.

Figure 4:
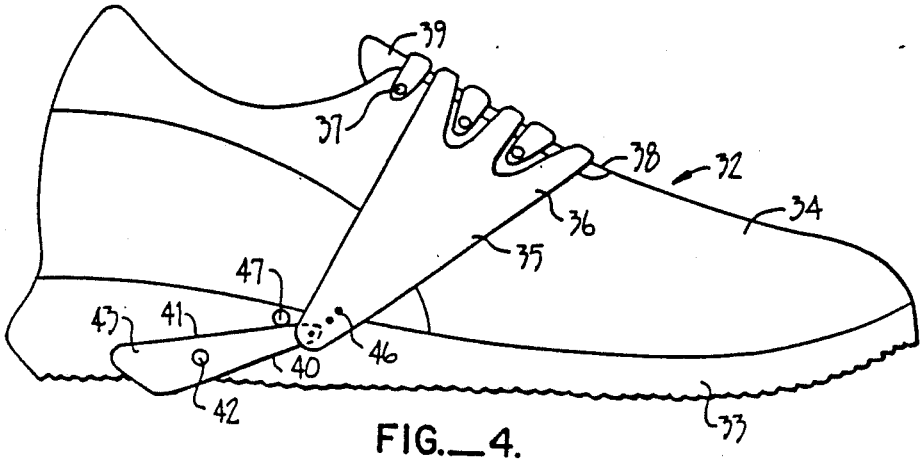
FIG. 4 is a side elevational view of a shoe including a dynamic fitting and shock absorbtion system constructed in accordance with another embodiment of the present invention.
Figure 5:
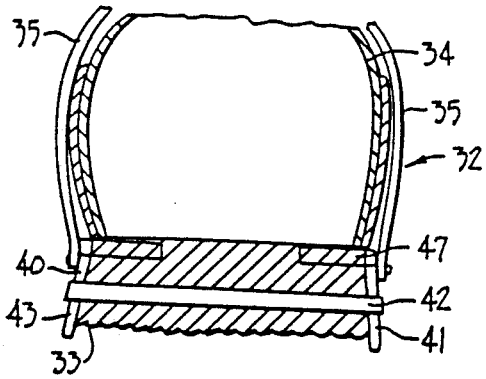
FIG. 5 is a vertical section through the shoe of FIG. 4.
Figure 6:
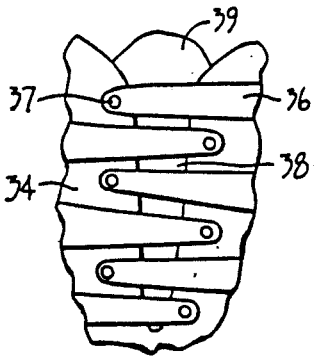
FIG. 6 is a partial top view of the shoe of FIG. 4.

Referring to FIGS. 4–6 in another embodiment of the present invention, a shoe 32 has a lower sole 33 and an upper shell 34 secured to the sole. The upper shell includes a v-shaped cut out 38 above the midfoot and forefoot. A tongue 39 underlies the cut out and is secured in the vicinity of the toe end of the shoe. Instep straps 35 include finger like projections 36 which are secured by rivets 37 or the like to the shell adjacent to the cut out. The straps extend over the cut out and downwardly and rearwardly in an inclined direction and are attached on the opposite ends to the upper segments 40 of elongated pivot bar members which are fixed to a rod 42 which rotatable extends through a bore in the sole of the shoe to the comparable pivot bar on the opposite side on the sole. Lower segments 43 of the pivot bars are shaped to engage the contact surface during heel strike. The instep straps include adjustment holes 46. Stops 47 attached to the sole prevent excessive counterclockwise rotation of the pivot bars and straps.

In use, and after instep straps 35 have been adjusted there is a close comfortable fit in an unweighted condition with the lower segments of the pivot bars projecting below the bottom of the sole. During heel strike, the pivot bars rotate in a clockwise direction pulling the instep straps downwardly and rearwardly closing the v-shaped cut out and tightening the upper on the foot. Upon unweighting during toe off, the pivot bars are rotated in a counterclockwise direction loosening the instep straps and the shoe upper to the close comfortable fit.

Figure 7:
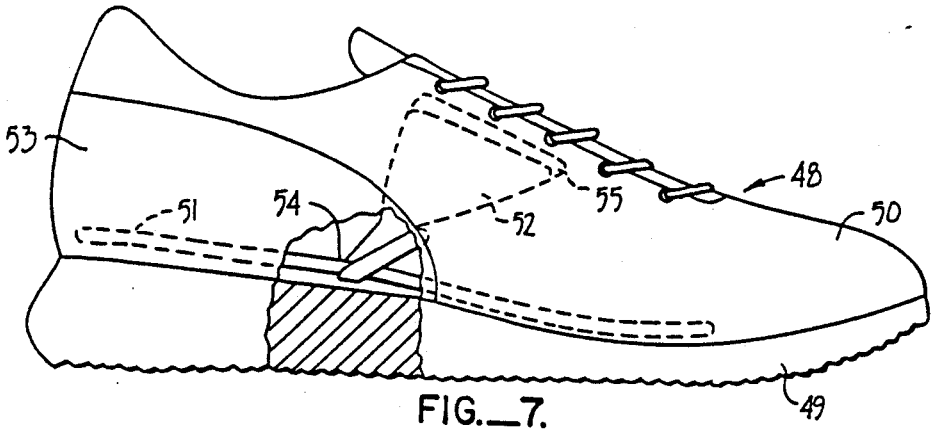
FIG. 7 is a side elevational view of a shoe including a dynamic fitting and shock absorbtion system constructed in accordance with another embodiment of the present invention.
Figure 8:
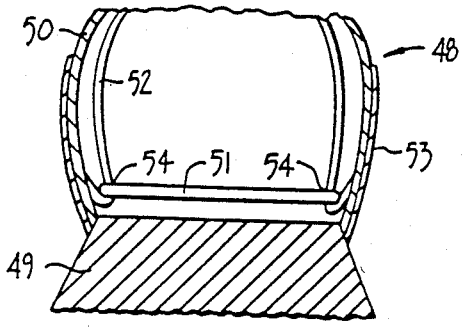
FIG. 8 is a vertical section through the shoe of FIG. 7.

Referring now to FIGS. 7 and 8 in another embodiment of the present invention, a shoe 48 has a lower sole 49 and an upper shell 50 secured to the sole. A footbed 51 extends from the heel to the ball of the foot. One end of an instep strap 52 is connected to the inside of the medial heel counter 53 wall and then passes upwardly through a slot 54 in the medial side of the footbed, is directed forwardly and upwardly in an inclined direction and is flared over the instep. The instep strap then passes rearwardly and downwardly through a slot 54 in the lateral side of the footbed and is connected to the inside of a lateral heel counter 53 wall. The instep strap 52 may be fitted with an adjustable fastener such as snaps or a Velcro® fastener 55 so that it can be adjusted for feet of differing sizes.

In use, and after the instep strap has been tightened there is a close comfortable fit in an unweighted condition with the footbed resting a distance above the sole. When the user's weight is placed on the footbed, the footbed moves downwardly toward the sole. The instep strap is tightened over the instep and forefoot. This is due to relative shortening of the instep strap over the foot as the distance is increased from the instep strap attachment on the heel counter to the footbed. As a result of the increased force applied to the instep strap, relative movement between the shoe and the foot including excessive pronation and supination is prevented. Upon unweighting of the footbed the force on the instep strap is reduced loosening the shoe on the foot to the close comfortable fit.

Figure 10:
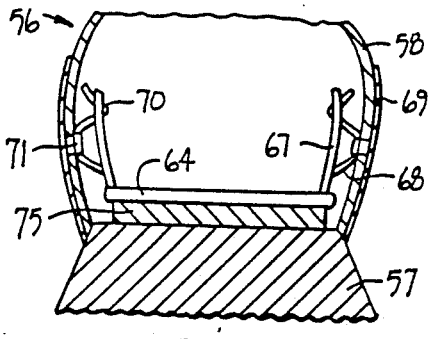
FIG. 10 is a vertical section through the shoe of FIG. 9.
Figure 9:
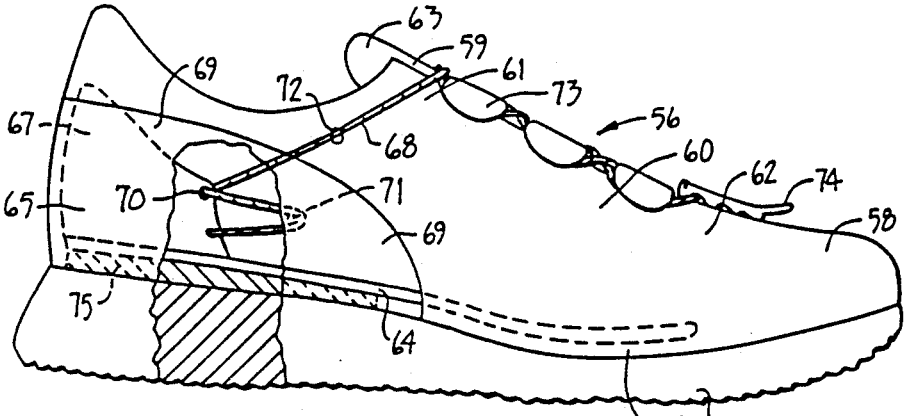
FIG. 9 is a side elevational view of a shoe including a dynamic fitting and shock absorbtion system constructed in accordance with another embodiment of the present invention.

Referring to FIGS. 9 and 10 in another embodiment, a shoe 56 has a lower sole 57 and an upper shell 58. The upper of the shoe includes a conventional, typically v-shaped cut out 59 generally above the forefoot 60 and extending generally from about the instep 61 towards the front or toe end 62 of the shoe. A tongue 63 underlies the cut out in a conventional manner and normally is secured to the upper in the vicinity of the toe end. Disposed within the shoe is a footbed 64, extending from the heel end 65 to the area of the ball 66 of the foot. The footbed includes a semirigid heel cup 67 which is shaped to fit over the heel of the user's foot. A lace or cable 68 is secured to the heel cup, passes around a guide 71 on the inside wall of a heel counter 69 through an islet 70 in the heel cup and then extends outwardly through an opening 72 in the shoe upper wall. The lace extends there from on each side of the outside of the shoe in a generally forward and upwardly inclined direction to a series of closure guides or pulleys 73 arranged on each side and spaced over the length of the v-shaped cut out in the upper of the shoe to about the end of the cut out. An overcenter clamp 74 is secured to the upper in the vicinity of the toe end, which, when closed, pulls on the lace and thereby closes the v-shaped cut out and generally tightens the laces. Load distributing compressible material 75 may be located between the footbed and lower sole.

In use, the foot is placed inside the shoe and the over center clamp is adjusted and closed to establish a initial close fit of the shoe on the foot in the unweighted condition. The shoe is now ready for use. Downward force of the footbed such as would occur when the foot pushes the shoe against the ground in court sports, closes the v-shaped cut out and tightens the upper and the heel cup on the foot. This is due to relative shortening of the lace between the overcenter clamp and the heel cup as the relative length of the lace increases between the heel cup and the heel counter attachment.

Figure 11:
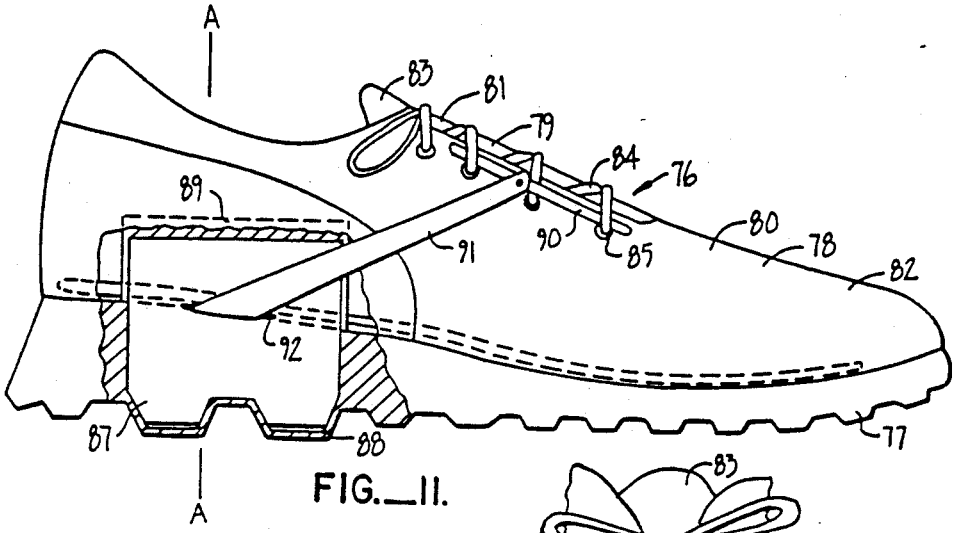
FIG. 11 is a side elevational view of a shoe including a dynamic fitting and shock absorbtion system constructed in accordance with another embodiment of the present invention.
Figure 13:
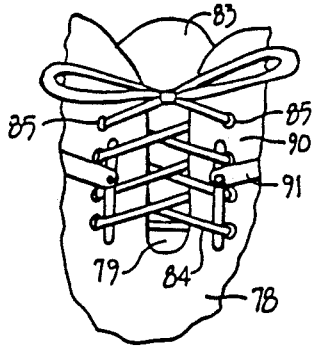
FIG. 13 is a partial top view of the shoe of FIG. 11.
Figure 12:
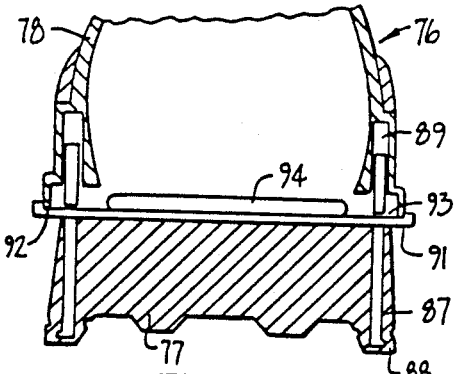
FIG. 12 is a vertical section through the shoe of FIG. 11.

Referring to FIGS. 11–13 in still another embodiment, a shoe 76 has lower sole 77 and upper shell 78. The upper shell of the shoe includes a conventional typically v-shaped cut out 79 above the forefoot 80 and extending generally from about the instep 81 towards the toe end 82 of the shoe. A tongue 83 underlies the cut out. A lace 84 passes through multiple eyelets 85 from the toe end of the cut out to the instep end. The lace passes from each eyelet on the outside of the shell to each eyelet on the inside of the shell on the opposite side of the cut out. The lace is tied in the conventional manner. Slidably disposed within cavities in the medial and lateral sides of the resilient compressible elastomer sole 77 are stabilizing plates 87. The upper ends of the plates 87 extend upwardly from collapsible studs 88 in sole 77 and are slidably received in boxes 89 located on the sides of the shoe 76. The plates are located within upwardly collapsible studs extending below the tread of the sole and can slide upwardly in the cavities in response to upward loading of the studs and sole such as occurs in foot strike or weight bearing between the foot, shoe and contact surface. The slidable plates provide lateral stability for the shoe and foot during foot strike. A bar 90 is located on the outside of each side of the cut out in the shell between the lace and the shell at alternate eyelets and between the eyelets and the cut out. A strap 91 is secured on the central area of each bar 90 by a rivet or the like and passes in a downwardly and rearwardly inclined direction and through a slot 92 on the outside of each box 89. The strap 91 then passes through a slot 93 in each plate 87 and under a semirigid movable footbed 94 located in the interior of the shell. The footbed may be non-movable.

In use, the foot is placed inside the shoe and the lace tightened and tied to establish an initial close fit of the shoe in the unweighted condition. Tightening the lace pulls the bar upwardly and inwardly pulling the plates downwardly until the slots in the plates and boxes coincide. Foot strike collapses the studs pushing the plates upwardly in the boxes. There is relative shortening of the strap between the boxes and the cut out tightening the lace, narrowing the cut out and elevating the footbed. Thus, there is reduced movement between the foot and the shoe and redistribution of the shock load.

Figure 14:
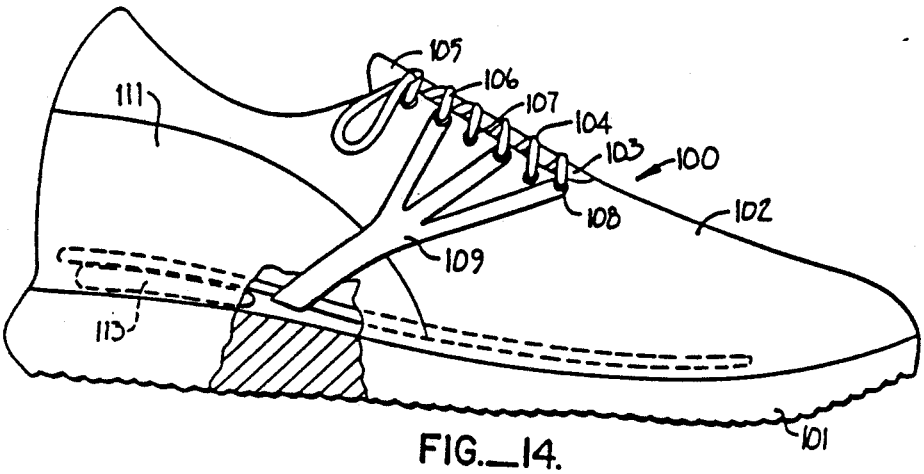
FIG. 14 is a side elevational view of a shoe including a dynamic fitting and shock absorbtion system constructed in accordance with another embodiment of the present invention.
Figure 15:
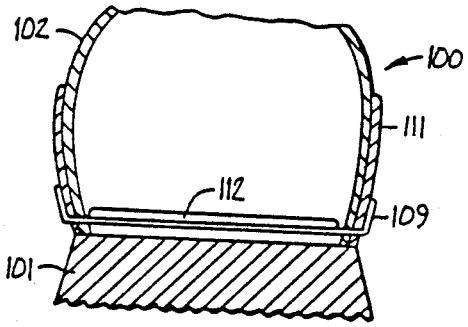
FIG. 15 is a vertical section through the shoe of FIG. 14.
Figure 16:
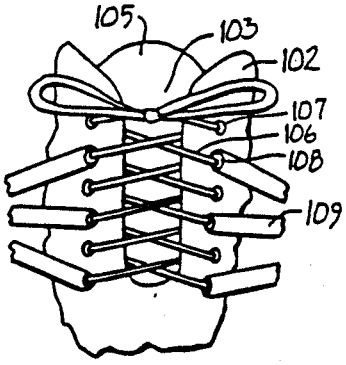
FIG. 16 is a partial top view of the shoe of FIG. 15.
Figure 17:
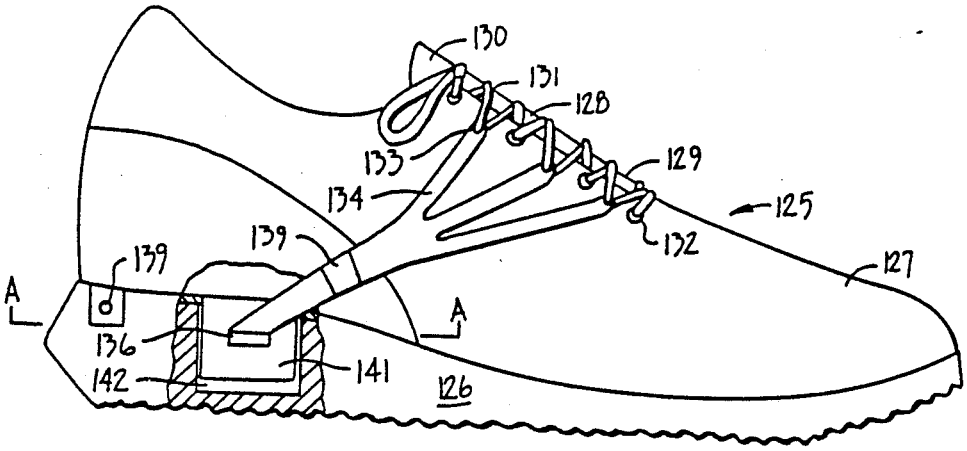
FIG. 17 is a side elevational view of a shoe including a dynamic fitting and shock absorbtion system constructed in accordance with another embodiment of the present invention.
Figure 18:
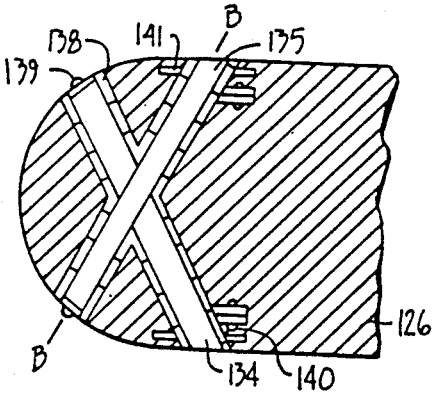
FIG. 18 is a partial horizontal section through the shoe taken along line A—A.
Figure 19:
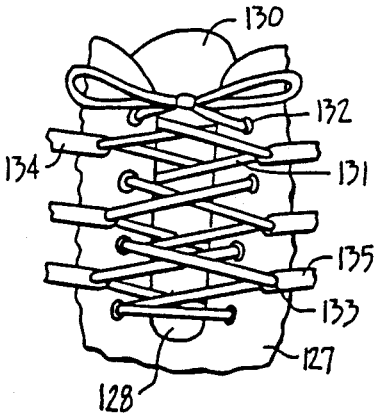
FIG. 19 is a partial top view of the shoe of FIG. 17.
Figure 20:
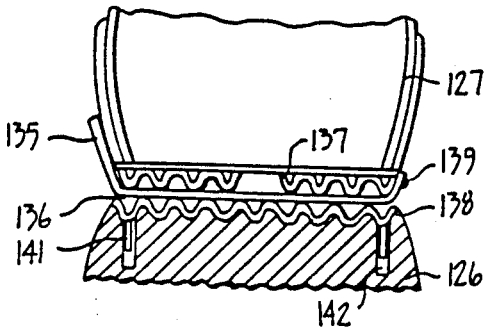
FIG. 20 is a vertical section through the shoe taken along line B—B of FIG. 18.

Referring to FIGS. 14–16 in still another embodiment, a shoe 100 has a lower sole 101 and an upper shell 102. The upper shell of the shoe includes a conventional v-shaped cut out 103 above the forefoot 104. A tongue 105 underlies the cut out. A lace 106 passes through eyelets 107 from the toe end of the cut out to the instep end. The lace passes from the eyelet on the outside of the shell to each eyelet on the inside of the shell on the opposite side of the cut out. The lace is tied in the conventional manner. The lace also passes through eyelets 108 in finger like projections of a strap 109 located on each side of the cut out at alternate eyelet 108 positions. The strap passes downwardly and rearwardly to a slot 110 located in the heel counter 111 and upper shell 102 above the level of the upper surface of the lower sole. The strap then passes slidably through slot 110 and under a semirigid footbed 112. Resilient compressible material 113 or a gas chamber lies between the footbed and the lower sole. Alternatively, separate strap ends pass through slots in the side of the footbed and attach to the inner side of the heel counter on the same side of the shoe or pass under the footbed and attach to the opposite heel counter wall.

In use, the foot is placed inside the shoe and the lace is tightened and tied on the upper shell to establish a close comfortable fit. As the lace is tightened, the footbed is elevated from the lower sole. The strap length and slot height are predetermined to elevate the footbed a predetermined distance above the sole when the strap and shell eyelets coincide in position. During foot strike, the footbed is lowered toward the sole pulling the lace and strap downwardly and rearwardly tightening the upper shell on the foot. As a result, a portion of the impulse shock load of foot strike is distributed from the bottom of the sole of the foot to the side and top of the foot. The dynamic tightening on the heel, midfoot and forefoot allows a less critical fit in the shop and reduced foot slippage in the shoe and consequent micro injury and energy loss.

Referring to FIGS. 17–20 in still another embodiment, a shoe 125 has a lower sole 126 and upper shell 127. The upper shell of the shoe includes a conventional V-shaped cut out 128 generally above the forefoot 129. A tongue 130 underlies the cut out. A lace 131 secured to the upper shell passes through eyelets 132 from the toe end of the cut out to the instep end. The lace passes from each eyelet on the outside of the shell to each eyelet on the inside of the shell on the opposite side of the cut out. The lace is tied in the conventional manner. The lace also passes through eyelets 133 in finger like projections of straps 134 and 135 located on each side of the cut out between eyelet 132 positions. The straps which may have elastic segments 139 and which may in an alternative embodiment pass through slots in the side of the shoe and over the instep, pass downwardly and rearwardly to slots 136 located in the sides of resilient compressible lower sole 126. The straps then pass between upper and lower complimentary meshing folded or corrugated surfaces of an elastomer sole section or between plates 137 and 138 embedded in the resilient lower sole 126. The folded plates can be located in the shell or at the surface interface between the shell and sole or in the sole and include a large interface surface. Each strap is attached by a rivet 139 or the like to the upper corrugated plate at the opposite side of the shoe. The corrugated plates are preferably constructed of a semirigid plastic to allow some flexibility during foot strike. The plates are preferably riveted at 140 to form stabilizing hinged plates. The upper plate includes rigid or semirigid downwardly extending plate members 141 shiftable relative to the lower sole. The plate members 141 slide in slots 142 in the resiliently compressible lower sole as the sole is compressed during foot strike weighting. This provides lateral stability during foot strike weighting and allows the potential vertical compression of the lower sole shock absorber available for energy absorption.

In use, the foot is placed inside of the shoe and the lace is tightened and tied on the upper shell to establish a close comfortable fit. Because of the dynamic fitting system, the shoe is easier to fit than a conventional sport shoe. As the lace is tightened, the straps 134 and 135 are held in a tightly drawn position. During weighting, the straps are pulled downwardly and rearwardly tightening the upper shell on the foot. The shock load impulse of foot strike is distributed to the midfoot and forefoot while the shoe is dynamically tightened on the wearer's foot.

Figure 21:
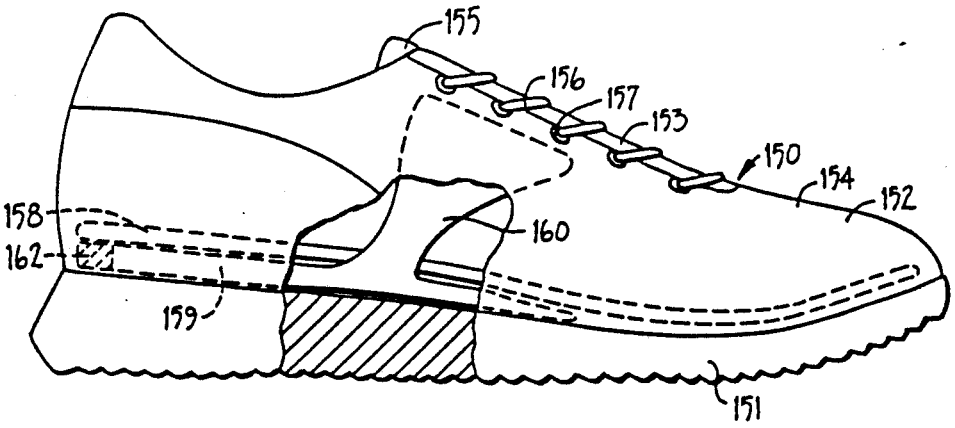
FIG. 21 is a side elevational view of a shoe including a dynamic fitting and shock absorbtion system constructed in accordance with another embodiment of the present invention.
Figure 22:
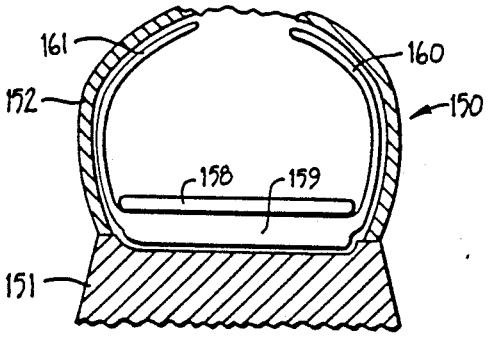
FIG. 22 is a vertical section through the shoe of FIG. 21.

Referring to FIGS. 21 and 22 in still another embodiment, a shoe 150 has a lower sole 151 and upper shell 152. The upper shell of the shoe includes a conventional V-shaped cut out 153 generally above the forefoot 154. The cut out may be located at the side or rear of the shoe. A tongue 155 underlies the cut out. A lace 156 passes through eyelets 157 and is tied in the conventional manner. A semirigid movable footbed 158 extends from the heel to the toe of the shoe. A bladder 159 lies between the footbed and the lower sole and has fluid passages communicating with bladders 160 and 161 which are directed forwardly and upwardly in an inclined direction and flared over each side of the instep. Bladders may be located on each side of the heel to further reduce pronation during weighting of the shoe. The fluid distensible bladders contain gass such as air or Freon or an oil or other flow material. If an air filled bladder is used it may have a flap valve known per se (not shown) to refill the bladder in the unweighted condition. A compressible spring member 162 lies between the footbed and the lower sole to elevate and stabilize the footbed in the unweighted condition and to allow the contents of bladders 160 and 161 to flow into bladder 159. The bladders may be an integral part of the shoe and incorporated into the sole and side walls of the shoe or provided as a kit that is adapted to be placed into a conventional sport shoe.

In use, the foot is placed inside of the shoe and the lace is tightened and tied to establish an initial close fit in the unweighted condition. During the weighting of foot strike, the footbed is lowered toward the sole. The larger bladder 159 is compressed forcing the bladder contents into the smaller bladders 160 and 161 tightening the shoe on the foot and dispersing the shock load.

Details have been disclosed to illustrate the invention in a preferred embodiment of which adaptions and modifications within the spirit and scope of the invention will occur to those skilled in the art. The scope of the invention is limited only by the following claims.

What is claimed:

1. In a shoe including an upper shell and a lower sole secured to the upper shell, the improvement comprising means for sensing when a user of the shoe applies increased weight to the sole upon touching a support surface for the shoe, and tightening means responsive to the sensing means for increasing the tightness of the fit of the shoe on a foot of the user as the user applies the increased weight to the sole.

2. A shoe according to claim 1 including adjusting means for varying the degree to which the tightness of the fit is increased by the tightening means.

3. A shoe according to claim 1, wherein the sensing means includes a footbed movable relative to the shoe.

4. A shoe according to claim 3, wherein tightening means includes a strap for increasing the tightness of the fit of the shoe on the foot when the footbed is moved.

5. A shoe according to claim 3, wherein the sensing means includes a heel cup secured to the footbed and formed to engage the heel of the foot.

6. A shoe according to claim 5 including means operatively coupled with the sensing means and the tightening means for increasing the tightness of the heel cup on the foot when the footbed is moved.

7. A shoe according to claim 1 wherein the sensing means includes a strap formed to engage the upper surface of the shoe.

8. A shoe according to claim 1, wherein the tightening means includes means for increasing the tightness of the fit of the upper shell on a foot heel.

9. A shoe according to claim 1, wherein the tightening means includes means for increasing the tightness of the fit of the upper shell on a foot instep.

10. In a shoe including an upper shell and a lower sole secured to the upper shell, the improvement comprising an apparatus coupled to the shoe for increasing the tightness of the fit of the shoe on a foot during weighting of the shoe, the apparatus including, a footbed movable relative to the shoe, a strap for increasing the tightness of the fit of the shoe on the foot when the footbed is moved, said strap being formed to secure to the footbed on one end and secure to a bar pivotably secured to the footbed on the other end.

11. A shoe according to claim 10, wherein said bar is formed to engage the lower sole.

12. In a shoe including an upper shell and a lower sole secured to the upper shell, the improvement comprising an apparatus coupled to the shoe for increasing the tightness of the fit of the shoe on a foot during weighting of the shoe, the apparatus including a strap formed to engage an upper surface of the shoe and being formed to engage a member pivotably secured to the shoe.

13. A shoe according to claim 12 wherein said apparatus further includes means for increasing the tightness of the upper shell on the foot when the member is pivoted during weighting of the shoe.

14. A shoe adapted to fit over a foot of a user comprising a sole, a shell secured to the sole, a sensor operatively coupled with the sole for sensing the weight applied by the user to a portion of the sole when the sole is in contact with a support surface, tightening means for engaging an upper surface of the foot, and connecting means operatively coupled with the sensor means and the tightening means for forcing the tightening means towards the upper surface of the foot in response to and as a function of the user's weight applied to the portion of the sole to thereby temporarily increase the tightness with which the tightening means engages the foot for as long as the user applies the weight to the portion of the sole.

15. A shoe according to claim 14 wherein the sensor is formed to provide lateral stability for the foot while the user applies his weight to the sole.

16. A shoe according to claim 15 wherein the sensor includes a member shiftable relative to said sole.

17. A shoe according to claim 16 wherein the tightening means includes straps extending from the sole and formed to engage an upper surface of the shoe.

18. A shoe according to claim 17 wherein said straps are formed to engage a lace secured to the shell for increasing the tightness of the fit of the lace on the shoe while the user applies his weight to the sole.

19. A shoe according to claim 14 wherein the tightening means includes a distensible bladder.

20. A shoe according to claim 19 wherein said bladder contains a fluid.

21. In a shoe including an upper shell and a lower sole secured to the upper shell, the improvement comprising an apparatus coupled to the shoe including a member located at the sole and movable relative to the sole for increasing the tightness of the fit of the shoe on a foot during weighting of the shoe and complementary meshing corrugated surfaces located at the lower sole.

22. A shoe according to claim 21 wherein said apparatus further includes means for engaging the straps between the complimentary meshing corrugated surfaces for increasing the tightness of the straps on the shoe during weighting of the shoe.

23. A shoe adapted to fit over a foot of a user comprising sole means adapted to support the user's weight and formed to be compressed when the user applies his weight thereto, holding means for engaging an upper surface of the foot, and tightening means operatively coupling the sole means and the holding means and formed to move the holding means generally towards the sole means when the sole means is compressed by an amount sufficient to increase the force applied by the holding means to the upper surface of the foot as compared to the force applied by the holding means to the upper surface of the foot when the sole means is in a relatively uncompressed state.

* * * * *